United States Patent [19]

Tisdale, Jr.

[11] 4,385,655

[45] * May 31, 1983

[54] METHOD AND APPARATUS FOR PRODUCING INGOT MOLD CAPS

[76] Inventor: Norman F. Tisdale, Jr., Valencia, Pa. 16059

[ * ] Notice: The portion of the term of this patent subsequent to Aug. 3, 1999, has been disclaimed.

[21] Appl. No.: 397,794

[22] Filed: Jul. 13, 1982

Related U.S. Application Data

[63] Continuation-in-part of Ser. No. 154,102, May 28, 1980, Pat. No. 4,342,357.

[51] Int. Cl.[3] ..... B22D 19/00

[52] U.S. Cl. ..... 164/112; 164/137; 249/112; 249/204

[58] Field of Search ..... 164/111, 112, 33, 72, 164/137, 271, 412; 249/204, 174, 135, 106, 111, 112

[56] References Cited

U.S. PATENT DOCUMENTS

| | | | |
|---|---|---|---|
| 2,143,410 | 1/1939 | Dornin | 164/412 X |
| 2,231,774 | 2/1941 | Rigdon | 249/204 |
| 2,757,426 | 8/1956 | Brennan | 249/112 X |
| 2,882,568 | 4/1959 | Leaberry et al. | 164/138 |
| 4,250,946 | 2/1981 | Monta | 164/138 X |

FOREIGN PATENT DOCUMENTS

| | | | |
|---|---|---|---|
| 51-16162 | 5/1976 | Japan | 164/41 |

*Primary Examiner*—Gus T. Hampilos
*Assistant Examiner*—J. Reed Batten, Jr.
*Attorney, Agent, or Firm*—Buell, Blenko, Ziesenheim & Beck

[57] ABSTRACT

An apparatus and method for producing ingot mold caps is provided in which a shaped opening in a chill element is lined with a pre-formed refractory/ceramic fiber pad and metal is cast in the lined opening around a cored lift engaging means.

8 Claims, 4 Drawing Figures

METHOD AND APPARATUS FOR PRODUCING INGOT MOLD CAPS

This application is a continuation-in-part of my copending application, Ser. No. 154,102, filed May 28, 1980 and now U.S. Pat. No. 4,342,357 issued Aug. 3, 1982.

This invention relates to apparatus and method for producing ingot mold and/or other castings and particularly to an apparatus and method for producing ingot mold caps in substantially finished form.

Ingot mold caps are used in the production of certain types of steel, generally known as capped steel. In this practice steel is poured into a big end down, bottle top mold. Steel is teemed into the ingot mold and rimming action is generally permitted for a minute or two, after which a cast iron cap is applied. The addition of a small amount of aluminum during pouring insures that the steel will rise and press against the cap. The cap acts as a chill and closes off the top of the ingot which typically has a somewhat honeycomb or sponge like interior which will close up on heating and rolling.

Typically ingot mold caps are made by a cope and drag sand molding process in which patterns are placed in the cope and drag sections and sand is molded around the patterns to form the mold for casting the ingot mold cap. The cope and drag are assembled with appropriate gates, chills, dowels, etc. The iron is then cast, cooled, the cope removed from the drag, and the casting removed from the drag. The casting must be cleaned by hand using a pneumatic chipper to remove the sand adhering to the casting.

The present invention provides a new and improved method for producing ingot mold caps which utilizes a formed insulative board, a formed chill and a core. The practices of this invention markedly simplifies the making of ingot mold caps, eliminates the expense and problems of surface cleaning, produces a smoother, cleaner superior casting and provides a healthier foundry environment by eliminating the dust, dirt, fumes and the like normally associated with sand casting practices.

In my invention I provide a chill element having an opening therein corresponding in shape to the ingot mold cap desired, a formed refractory/ceramic fiber insulation pad of substantially uniform thickness fitted in said opening and a cored staple positioned in said pad. Preferably, the formed refractory/ceramic fiber pad is made of a refractory/ceramic fiber felt having about 45% to 60% $SiO_2$ and 40% to 55% alumina with usual impurities in ordinary amounts and most preferably about 55% $SiO_2$ and 45% alumina with the impurities in ordinary amounts and being substantially stable up to about 2300°F. and higher.

In the foregoing general description I have set out certain objects, purposes, and advantages of my invention. Other objects, purposes and advantages of this invention will be apparent from a consideration of the following description and the accompanying drawings in which.

Figure 1:
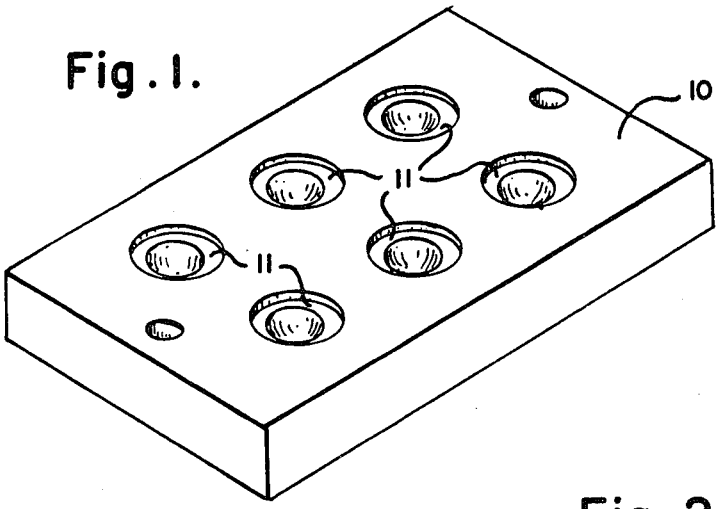
FIG. 1 is an isometric view of a chill according to my invention.
Figure 2:
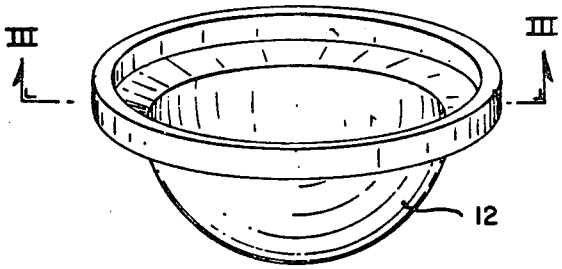
FIG. 2 is an isometric view of a formed refractory fiber pad for use in my invention.
Figure 3:
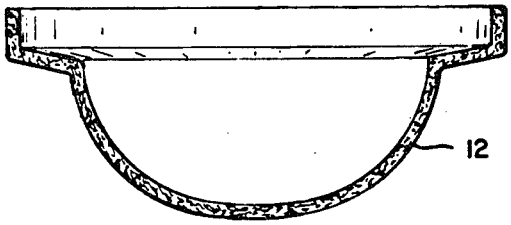
FIG. 3 is a cross section on the line III—III of FIG. 2.
Figure 4:
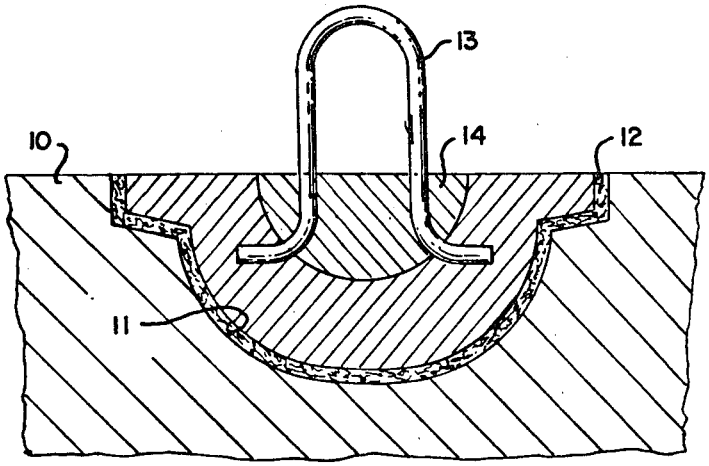
FIG. 4 is a fragmentary cross-sectional view through a portion of the chill, pad casting and cored staple of my invention.

Referring to the drawings I have illustrated a large elongate chill 10 in the form of a cast iron slab having a plurality of spaced openings 11 of the general shape of the desired casting for a mold cap. A pre-formed pad 12 of refractory/ ceramic fiber felt is placed in each opening 11. The refractory/ ceramic fiber felt used may have from 45% to 60% $SiO_2$, 40% to 55% $Al_2O_3$, about 0.2% $Fe_2O_3$, about 0.2% $Na_2O$ and about 2.5% ignition loss. A metal staple 13 or similar engaging means having a surrounding core 14 is centered in the pad 12 and supported appropriately. Cast iron is poured onto pad 12 around core 14 either directly or indirectly to fill the cavity. Once the iron has solidified the mold cap can be lifted from the chill by means of the staple 13 or other engaging means, a lifting hook and crane with very little, if any, finishing required.

This process and apparatus dramatically decreases labor costs and increases productivity in the foundry. Most importantly it eliminates sand molding which is a health hazard in most sand oriented foundries.

In the foregoing specification I have set out certain preferred practices and embodiments of my invention, however, it will be understood that this invention may be otherwise embodied within the scope of the following claims.

I claim:

1. Apparatus for producing ingot mold caps comprising a chill element having a cavity defined therein corresponding in shape to an ingot mold cap, a formed refractory/ceramic fiber felt insulation pad of substantially uniform thickness fitted in and lining said cavity and a core having a lift engaging means positioned centrally of said pad and spaced therefrom to form a metal receiving area between said core and pad, said left engaging means having portions extending out of the core into the metal receiving area, said pad comprising about 45% to 60% $SiO_2$, about 40% to 55% $Al_2O_3$ and the balance impurities in ordinary amounts.

2. An apparatus as claimed in claim 1 wherein the refractory/ceramic insulation pad is preformed of a refractory/ceramic fiber felt containing about 45% $SiO_2$ and about 55% $Al_2O_3$ with impurities in ordinary amounts and being stable up to about 2300°.

3. An apparatus as claimed in claim 1 or 2 wherein the chill element is an iron casting.

4. An apparatus as claimed in claim 1 or 2 wherein the chill element has a plurality of like cavities spaced apart on its surface.

5. A method for producing ingot mold caps comprising the steps of:

(a) forming a chill element having a cavity defined therein corresponding in shape to an ingot mold cap;

(b) placing a pre-formed pad of refractory/ceramic fiber felt insulation comprising about 45% to 60% $SiO_2$, about 40% to 55% $Al_2O_3$ and the balance impurities in ordinary amounts in said cavity as a fitted lining;

(c) placing a core having a lift engaging means centrally of said pad and spaced therefrom to form a metal receiving area between said core and pad, said left engaging means having portions extending out of the core into the metal receiving area;

(d) casting molten iron in the area between said pad and core;

(e) solidifying said iron; and (f) removing said solidified iron as completed ingot mold cap from said pad.

6. A method as claimed in claim 5 wherein the refractory/ceramic fiber insulation consists of about 45% $SiO_2$ and about 55% $Al_2O_3$ with impurities in ordinary amounts and is stable to about 2300°F.

7. A method as claimed in claim 5 or 6 wherein the chill element is an iron casting.

8. A method as claimed in claim 5 or 6 wherein the chill element has a plurality of like cavities spaced apart on its surface.

* * * * *